US005992539A

United States Patent [19]

Lin

[11] Patent Number: 5,992,539

[45] Date of Patent: Nov. 30, 1999

[54] PNEUMATICALLY DRIVEN POWER TOOL

[76] Inventor: Chen-Yang Lin, No. 52-1, Lane 490, Chung-Cheng S. Rd., Yang-Kang City, Tianan Hsien, Taiwan

[21] Appl. No.: 09/268,682

[22] Filed: Mar. 16, 1999

[51] Int. Cl.[6] ..... B25B 19/00

[52] U.S. Cl. ..... 173/93; 173/93.5; 173/169

[58] Field of Search ..... 173/93, 93.5, 93.6, 173/168, 169

[56] References Cited

U.S. PATENT DOCUMENTS

| | | | |
|---|---|---|---|
| 5,377,769 | 1/1995 | Hasuo et al. | 173/169 |
| 5,531,279 | 7/1996 | Biek | 173/93.5 |
| 5,544,710 | 8/1996 | Groshans et al. | 173/93.5 |
| 5,591,070 | 1/1997 | Kachlich | 173/169 |
| 5,901,794 | 5/1999 | Schoeps et al. | 173/169 |

*Primary Examiner*—Scott A. Smith
*Attorney, Agent, or Firm*—Finnegan, Henderson, Farabow, Garrett & Dunner, L.L.P.

[57] ABSTRACT

A pneumatically driven power tool includes a handle with air inlet and outlet passageways therein, and a transverse mounting housing. The mounting housing has a transverse circumferential portion with a rear abutment wall, a rear annular shoulder portion, an intermediate cylindrical wall segment, and a front annular shoulder portion. A rear bearing member and a rear mounting plate are inserted into the circumferential portion to abut respectively against the rear abutment wall and the rear annular shoulder portion, and are secured by a lockpin. A front mounting plate and a front bearing member are inserted into the circumferential portion to abut against the front annular shoulder portion and the front mounting plate, and are secured by another lockpin. A motor cylinder mates with the circumferential portion. A driven shaft is disposed in and is rotatable relative to the cylinder, and is journalled on the front and rear bearing members. The motor cylinder further has inlet and outlet ports respectively in fluid communication with the inlet and outlet passageways. Compressed air introduced from the inlet passageway into the inlet ports will drive the driven shaft, and will then be discharged from the outlet port via the outlet passageway.

5 Claims, 5 Drawing Sheets

PNEUMATICALLY DRIVEN POWER TOOL

BACKGROUND OF THE INVENTION

1. Field of the Invention

This invention relates to a pneumatically driven power tool, more particularly to a pneumatically driven power tool with a mounting housing in which front and rear bearing assemblies are insertably mounted so as to form a compact size.

2. Description of the Related Art

Referring to FIGS. 1 and 2, a conventional pneumatic tool 1 is shown to include a front housing 111, a rear housing 10, and a middle housing 11 with a mounting housing 112 and a handle 117. The handle 117 defines air inlet and outlet passageways 115,116 which extend in a longitudinal direction. The mounting housing 112 is connected to the front and rear housings 111,10 at front and rear ends thereof by a plurality of screw bolts 110 so as to form a receiving chamber 114 in a transverse direction relative to the longitudinal direction. A work output device 12, a front bearing seat 13, a motor cylinder 14 and a rear bearing seat 16 are disposed in the receiving chamber 114. The rear housing 10 has a receiving concavity 101 for receiving the rear bearing seat 16. An air regulator 17 is disposed in the inlet passageway 115. A regulator shaft 18 is disposed on the rear housing 10.

The motor cylinder 14 has an eccentric chamber 141 formed therein for receiving a driven shaft 15. The driven shaft 15 is mounted on the front and. rear bearing seats 13,16 at two ends thereof. The rear housing 10 is formed with forward and reverse guiding slots 102,103 around the receiving concavity 101, and a mounting hole 104 which extends in the transverse direction to communicate with the forward and reverse guiding slots 102,103. Forward and reverse outlet holes 106,107 and an inlet hole 105 are formed to communicate with the mounting hole 104 so as to communicate with the outlet passageway 116 and the inlet passageway 115. The forward and reverse outlet holes 106,107 are communicated with the forward and reverse guiding slots 102,103. The regulator shaft 18 has annular forward and reverse grooves 181,182. The rear bearing seat 16 has forward and reverse through holes 161,162.

When the forward groove 181 of the regulator shaft 18 is communicated with the inlet hole 105 and the forward guiding slot 102, compressed air can introduced into the eccentric chamber 141 via the inlet passageway 115, the inlet hole 105, the forward groove 181, the forward guiding slot 102, and the forward through hole 161 so as to actuate a forward operation of the driven shaft 15 for the work output device 12. Then, most of the compressed air introduced into the eccentric chamber 141 will be discharged from the outlet passageway 116 via outlet ports 142 disposed on the cylinder 14. A small portion of the compressed air will be discharged via the reverse through hole 162, the reverse guiding slot 103, the reverse groove 182, and the reverse outlet hole 107 A reverse operation of the driven shaft 15 is achieved in the same manner when the reverse groove 182 of the regulator shaft 18 is communicated with the inlet hole 105 and the forward guiding slot 102.

Since the conventional pneumatic tool has the front, rear and middle housings 111,10,11 which are connected together by a large number of the screw bolts 110 in a precise manner, the task of assembly as such is relatively inconvenient to conduct, and results in a bulky tool.

SUMMARY OF THE INVENTION

The object of the present invention is to provide a pneumatically driven power tool which can be assembled conveniently and which can be made to have a relatively small size.

According to this invention, the pneumatically driven power tool includes a handle which extends in a longitudinal direction and which defines air inlet and outlet passageways, and a mounting housing which is disposed on the handle and which is elongated in a transverse direction. The mounting housing has a rear end portion which extends in a direction transverse to the transverse direction, and a circumferential portion which defines an axis parallel to the transverse direction and which extends from a periphery of the rear end portion to form an annular coupling end opposite to the rear end portion. An inner circumferential wall includes a rear annular wall segment which forms with the rear end portion a rear abutment wall, a rear cylindrical wall segment of a dimension larger than that of the rear annular wall segment to form a rear annular shoulder portion, an intermediate cylindrical wall segment, a first front cylindrical wall segment of a dimension larger than that of the intermediate cylindrical wall segment so as to form a front annular shoulder portion, and a second front cylindrical wall segment.

A rear bearing member is inserted into the rear annular wall segment to abut against the rear abutment wall. A rear mounting plate is inserted into and mates with the rear cylindrical wall segment to abut against the rear annular shoulder portion. A motor cylinder is inserted into the intermediate cylindrical wall segment, and has a rearward wall to abut against the rear mounting plate, a forward wall, and a middle circumferential wall to mate with the intermediate cylindrical wall segment.

A driven shaft is disposed in and is rotatable relative to the motor cylinder, and has a rear portion which is journalled on a rear cylindrical bearing surface of the rear bearing member, a front portion which extends forward and outwardly of the motor cylinder, and a drive output end which extends forward from the front portion.

A front mounting plate is inserted into and mates with the first front cylindrical wall segment to abut against the front annular shoulder portion, and has a through hole for passage of the front portion of the driven shaft. A front bearing member is inserted into the second front cylindrical wall segment to abut against the front mounting plate, and has a forward abutment wall which defines a front cylindrical bearing surface to journal the front portion of the driven shaft. An annular retaining member has an annular engaging portion to engage the annular coupling end, and an annular retaining portion to abut against the forward abutment wall of the front bearing member so as to clamp the front bearing member in cooperation with the front mounting plate.

The motor cylinder further has inlet and outlet ports respectively in fluid communication with the inlet and outlet passageways. As such, the compressed air introduced from the inlet passageway into the inlet ports will drive the driven shaft, and will then be discharged from the outlet port via the outlet passageway.

The first and second circular circumferential walls respectively have first and second notches which extend inwardly and radially. First and second lockpins are inserted into the front and rear inserting bores to engage the first and second notches respectively so as to restrain rotations of the front and rear mounting plates about the axis.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
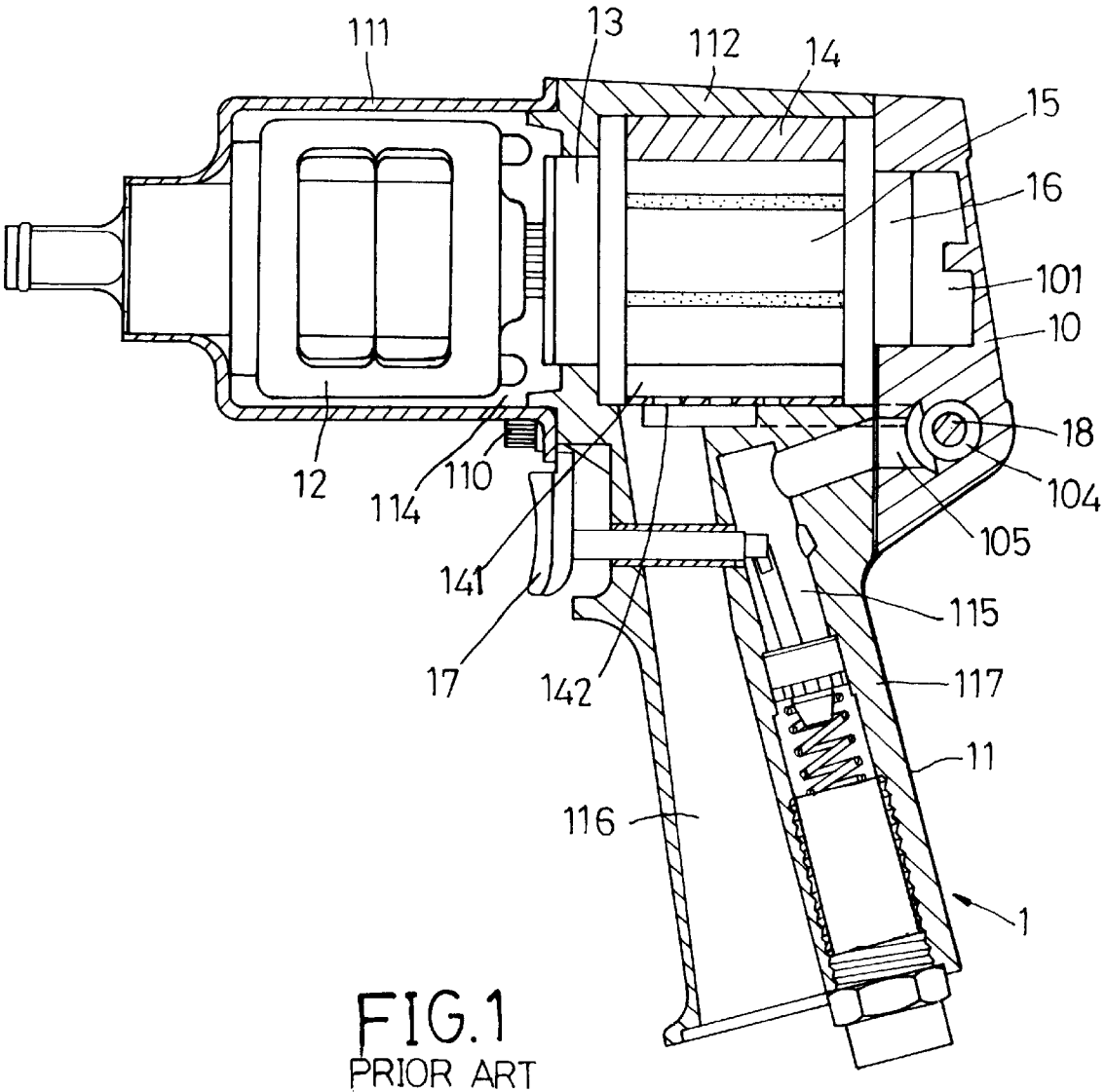
FIG.1 PRIOR ART
FIG. 1 is a sectional view of a conventional pneumatic tool.
Figure 2:
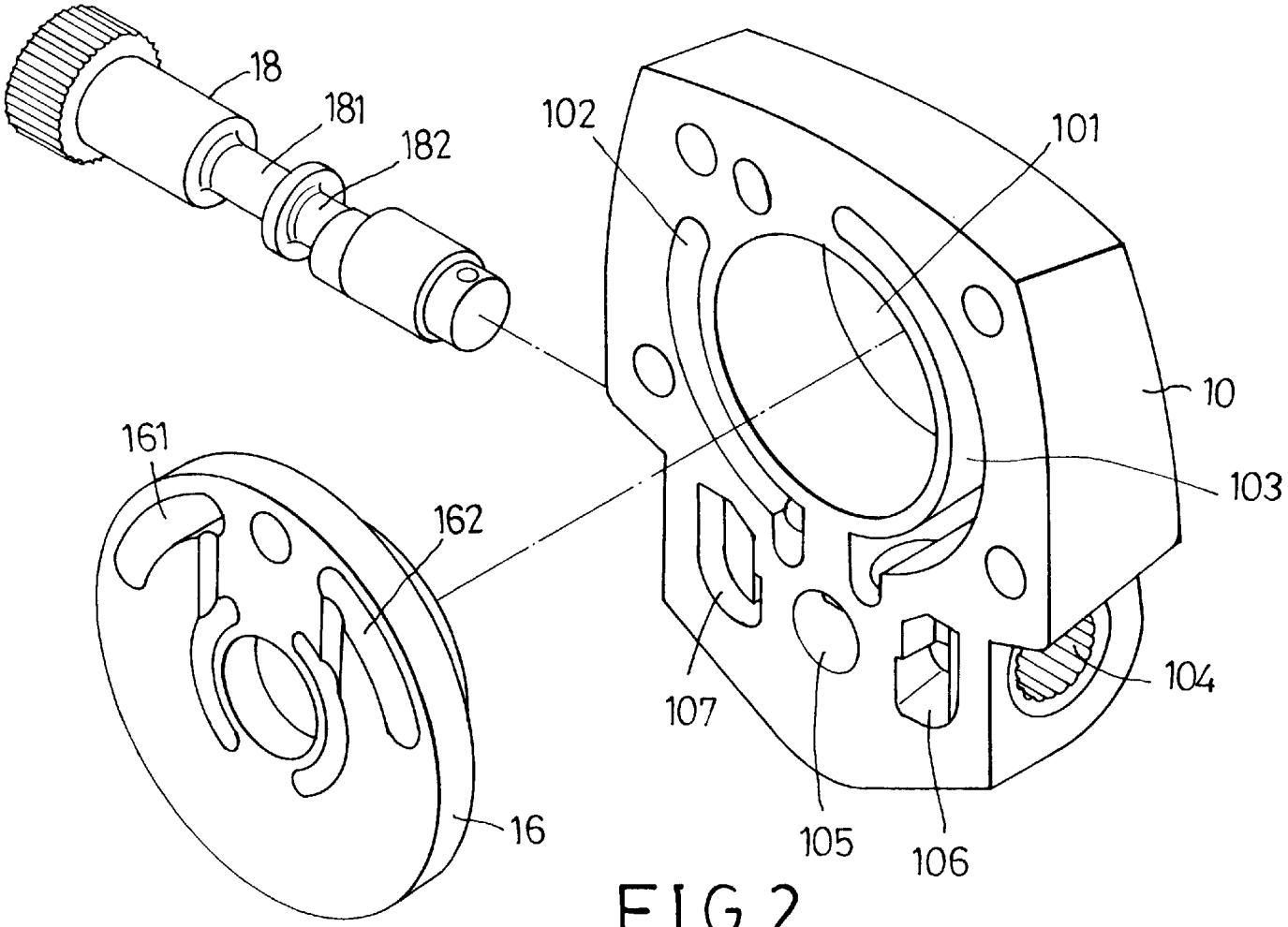
FIG. 2 PRIOR ART
FIG. 2 is a exploded view illustrating a rear bearing seat, a rear housing, and an air regulating shaft of the conventional pneumatic tool.
Figure 3:
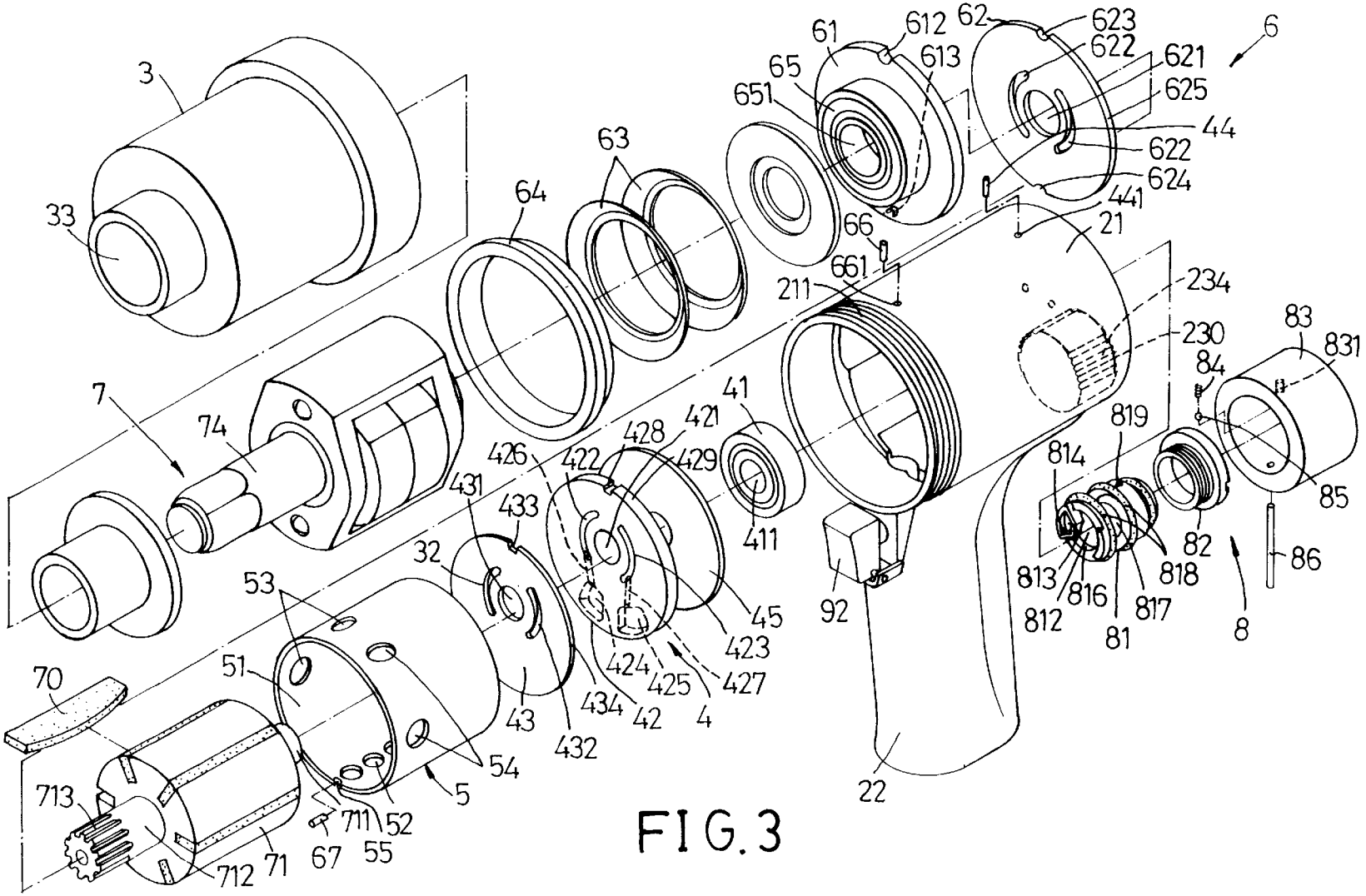
FIG. 3 is an exploded view of a preferred embodiment of a pneumatically driven power tool according to this invention.
Figure 4:
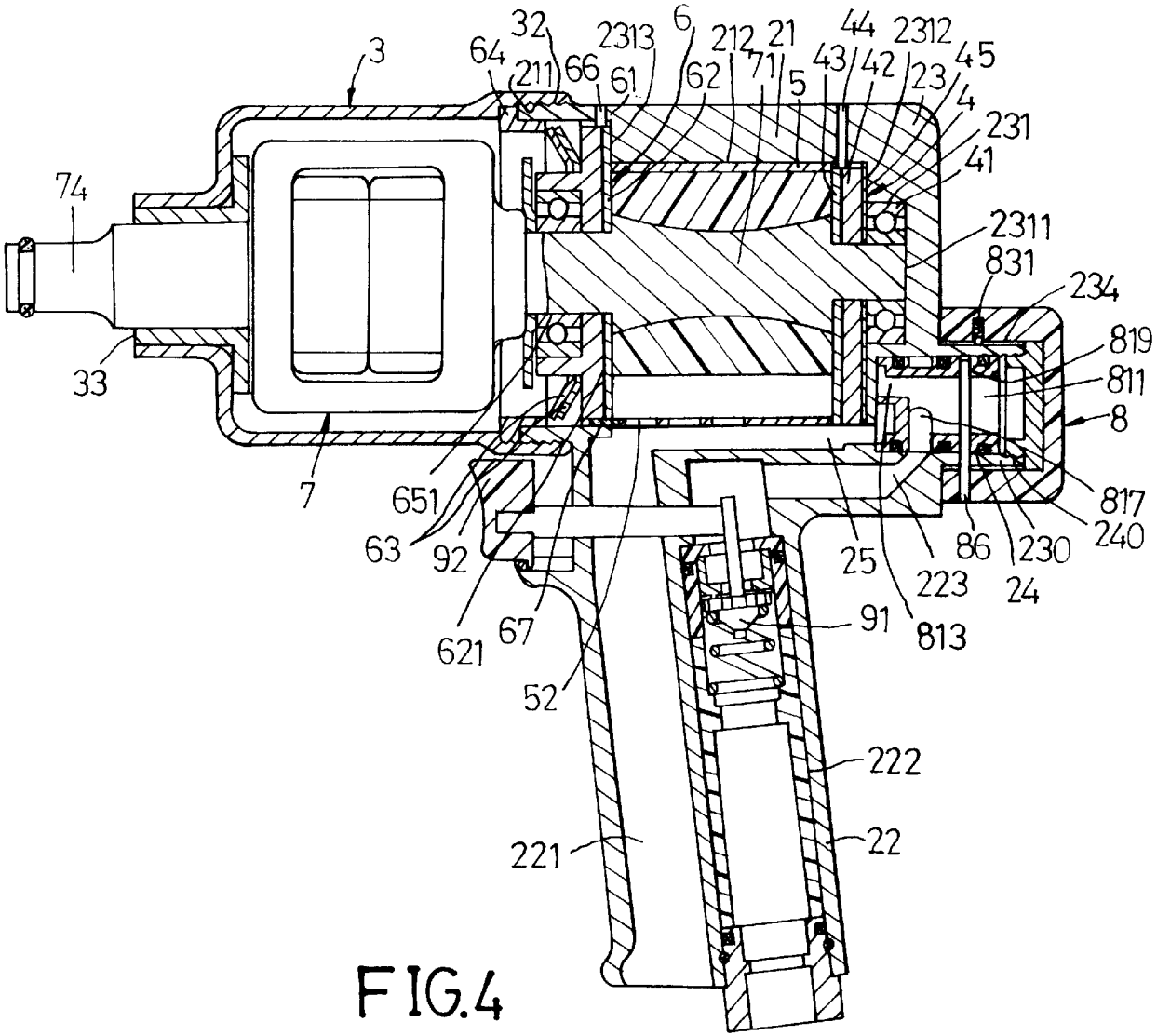
FIG. 4 is a sectional view of the preferred embodiment.

Referring to FIGS. 3 and 4, the preferred embodiment of the pneumatically driven power tool according to the present invention is shown to comprise a handle 22, a mounting housing 21, a rear bearing assembly 4, a motor cylinder 5, a driven shaft 71, a front bearing assembly 6, and a bypass power regulator 8.

The handle 22 has upper and lower ends opposite to each other in a longitudinal direction, and defines air inlet and outlet passageways 222,221 which extend in the longitudinal direction. The air inlet passageway 222 is adapted to be connected to a source of compressed air.

Figure 5:
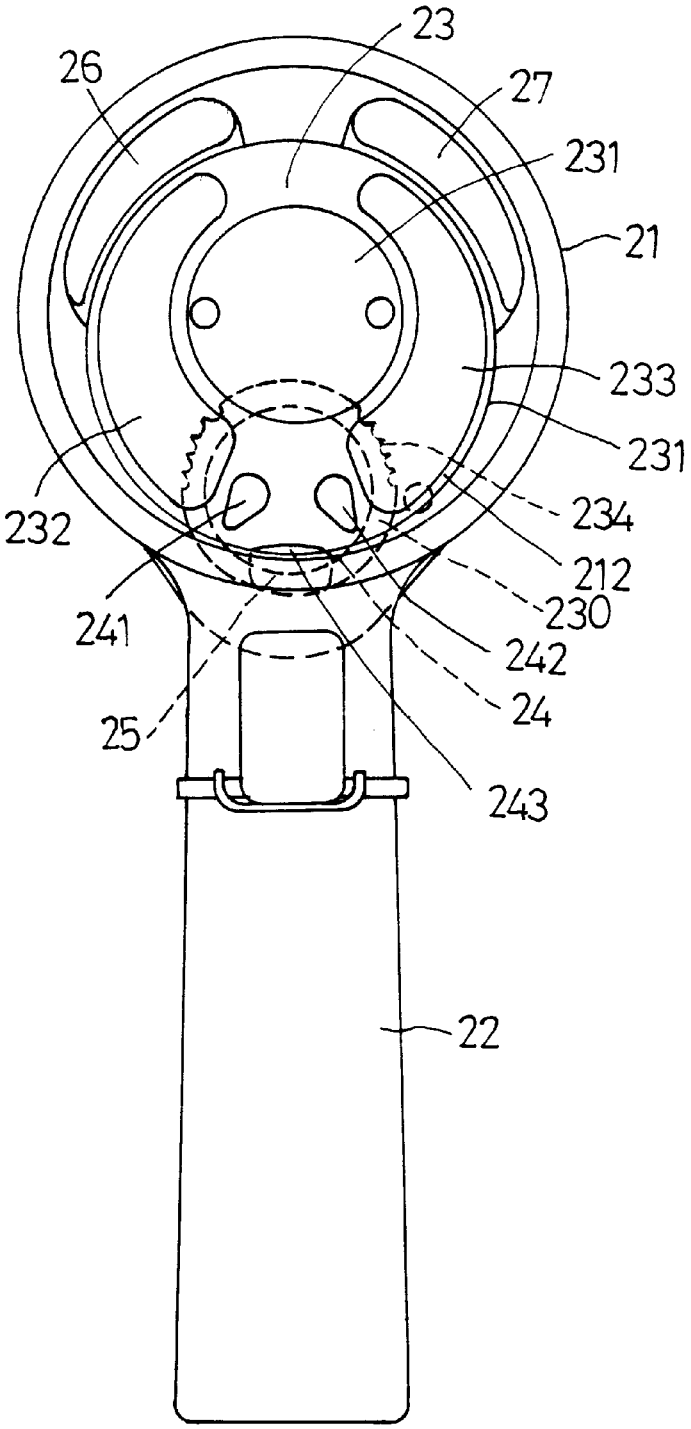
FIG. 5 is a front view of a base seat of the pneumatically driven power tool of the preferred embodiment.

The mounting housing 21 is disposed on the upper end of the handle 22, and is elongated in a first transverse direction relative to the longitudinal direction. The mounting housing 21 has a rear end portion 23 which extends in a second direction transverse to the first transverse direction. With reference to FIG. 5, the rear end portion 23 has an annular bearing receiving chamber 231, and forward and reverse guiding cavities 232,233 around the bearing receiving chamber 231. The mounting housing 21 further has a circumferential portion which defines an axis parallel to the first transverse direction, which is integrally formed with, and which extends from a first periphery of the rear end portion 23 in the first transverse direction to form a threaded annular coupling end 211. The circumferential portion has a cylinder receiving chamber 212 formed therein.

A back annular wall 230 extends rearward from the rear end portion 23 in the first transverse direction adjacent to the upper end of the handle 22, and has a receiving chamber 24 which is communicated with the upper end of the handle 22, a rear threaded portion 240, and a front portion which engages the rear end portion 23. The front portion has a forward port 241, a reverse port 242, and a discharge port 243 which are communicated with the cylinder receiving chamber 212 and which pass therethrough in the first transverse direction. The discharge port 243 is communicated with the air outlet passageway 221 by an exhaust passageway 25. The receiving chamber 24 is communicated with the air inlet passageway 222 via a connecting passageway 223. In addition, a series of positioning grooves 234 are formed on the back annular wall 230.

The circumferential portion has an outer circumferential wall which is secured to the upper end of the handle 22, and an inner circumferential wall opposite to the outer circumferential wall in a direction radial to the axis.

The inner circumferential wall includes a rear annular wall segment which is disposed around the axis and which forms with the rear end portion a rear abutment wall 2311 that is normal to the axis so as to confine the bearing receiving chamber 231. A rear cylindrical wall segment extends from the rear annular wall segment forwardly in the first transverse direction, and has a dimension larger than that of the rear annular wall segment so as to form a rear annular shoulder portion 2312 therebetween and normal to the axis. An intermediate cylindrical wall segment extends from the rear cylindrical wall segment in the first transverse direction towards the coupling end 211. A first front cylindrical wall segment extends from the intermediate cylindrical wall segment in the first transverse direction toward the coupling end 211, and has a dimension larger than that of the intermediate cylindrical wall segment so as to form a front annular shoulder portion therebetween and normal to the axis. A second front cylindrical wall segment extends from the first front cylindrical wall segment in the first transverse direction towards the coupling end 211.

The outer circumferential wall has front and rear inserting bores 661,441 which extend radially and inwardly to communicate with the inner circumferential wall respectively at the first front cylindrical wall segment and the rear cylindrical wall segment.

The rear bearing assembly 4 includes a rear bearing member 41, a rear mounting plate 42, a rear cover plate 43, and a paper plate 45. The rear bearing member 41 is inserted along the axis into the bearing receiving chamber 231 to abut against the rear abutment wall 2311, and has a rear cylindrical bearing surface 411 surrounding the axis. The rear mounting plate 42 is inserted along the axis into the rear cylindrical wall segment, and includes a first major wall which abuts against the rear annular shoulder portion 2312 and which has a through hole 421 that is aligned with the rear cylindrical bearing surface 411 of the rear bearing member 41. The rear mounting plate 42 further has a first circular circumferential wall 429 of a dimension to mate with the rear cylindrical wall segment. In addition, forward and reverse semi-circular ports 422,423 are formed around the through hole 421. Forward and reverse guiding holes 424,425 are communicated with the forward and reverse semi-circular ports 422,423 via connecting slots 426,427, respectively. The rear cover plate 43 has a through hole 431 and semi-circular slots 432 around the through hole 431. The rear mounting plate 42 and the rear cover plate 43 have notches 428,433 which are disposed in the circular circumferential walls 429,434 thereof and which extend inwardly and radially to register with the bore 441 such that a first lockpin 44 is inserted into the bore 441 to engage the notches 428,433 and restrain rotation of the rear mounting plate 42 and the rear cover plate 43 about the axis. The paper plate 45 is disposed between the mounting plate 42 and the shoulder portion 2312.

The motor cylinder 5 is inserted along the axis into the intermediate cylindrical wall segment, and includes a rearward wall normal to the axis so as to abut against the rear cover plate 43, a forward wall opposed to the rearward wall in the first transverse direction, and a middle circular circumferential wall 51 which is interposed between the rearward and forward walls and of such a dimension so as to mate with the intermediate cylindrical wall segment. The middle circular circumferential wall 51 has forward and reverse inlet ports 53, 54, outlet ports 52, and a notch 55. With reference to FIG. 5, the first front cylindrical wall segment has a forward conduit 26 which intercommunicates the forward guiding concavity 232 and the forward inlet ports 53, and a reverse conduit 27 which intercommunicates the reverse guiding concavity 233 and the reverse inlet ports 54.

The driven shaft 71 is disposed in and is rotatable relative to the motor cylinder 5, and has a rear portion 711 which extends rearward and outwardly of the motor cylinder 5 so as to be journalled on the rear cylindrical bearing surface 411 of the rear bearing member 41, a front portion 712 which extends forward and outwardly of the motor cylinder 5, and a drive output end 713 which extends forwards from the front portion 712.

The front bearing assembly 6 includes a front mounting plate 62 and a front bearing member 61 which are inserted along the axis into the first and second front cylindrical wall segments, respectively. The front mounting plate 62 has a second major wall which abuts against the front annular shoulder portion 2313, a through hole 621 for passage of the front portion 712 of the driven shaft 71, and two semi-circular slots 622 around the through hole 621. The front mounting plate 62 further has a second circular circumferential wall 625 of a dimension to mate with the first front cylindrical wall. Notches 623,624 extend inwardly and radially from the wall 625. The front bearing member 61 includes a rearward abutment wall which abuts against the front mounting plate 62 in the first transverse direction, and a forward abutment wall 65 which defines therein a front cylindrical bearing surface 651 surrounding the axis to journal the front portion 712 of the driven shaft 71 thereon. The front cylindrical bearing surface 651 extends to communicate with the forward abutment wall so as to permit the drive output end 713 to protrude forward and outwardly thereof for driving the rotation of a work output device 7. Notches 612,613 extend inwardly and radially from a circular circumferential wall of the rearward abutment wall. A second lockpin 66 is inserted into the bore 661 to engage the notches 623,612 and restrain rotation of the front mounting plate 62 and the front bearing member 61 about the axis. A third lockpin 67 engages the notches 55,613,624 so as to secure the motor cylinder 5 between the front and rear bearing assemblies 6,4.

Two annular retaining members 63 have annular engaging portions which engage the coupling end 211, and annular retaining portions to abut against the forward abutment wall 65 of the front bearing member 61 via a retaining sleeve 64 so as to clamp the front bearing member 61 in cooperation with the second major wall of the front mounting plate 62.

The work output device 7 is received in a front casing 3. The front casing 3 has a rear end 32 which engages threadedly the coupling end 211 of the mounting housing 21, and an open front end 33 which extends around the axis for passage of a rotating shaft 74 of the work output device 7.

The bypass power regulator 8 is disposed sealingly in the receiving chamber 24 via sealing rings 818 to divert and regulate the amount of the compressed air introduced from the inlet passageway 222 and passing through the mounting housing 21. The regulator 8 includes a regulator member 81 with an axial conduit 811, a regulating hole 813 at a proximate end 812 of the axial conduit 811, an inlet portion 817 to intercommunicate the inlet passageway 222 and the axial conduit 811, and an outlet portion 816 to communicate with the discharge port 243. A plug member 82 engages threadedly the rear threaded portion 240 of the back annular wall 230. A knob 83 is disposed rearward of the regulator member 81 in such a manner that an insert pin 86 passes through an insert hole 819 in the regulator member 81 and the knob 83, and can be actuated to rotate the regulator member 81 between a forward position where the regulating hole 813 is registered with the forward port 241, and a reverse position where the regulating hole 813 is registered with the reverse port 242. The knob 83 has a groove 831 which extends radially from an inner periphery thereof such that a ball 85 and a spring 84 are received between the groove 831 and one of the positioning grooves 234.

A valve member 91 is disposed in the inlet passageway 222, and is operated by a trigger 92 to admit the compressed air to flow into the inlet portion 817 of the regulator 8.

When the regulator member 81 is rotated to the forward position, the compressed air introduced from the inlet passageway 222 can flow into the motor cylinder 5 to rotate the driven shaft 71 via the connecting passageway 223, the inlet portion 817, the axial conduit 811, the regulating hole 813, the forward port 241, the forward guiding concavity 232, the forward conduit 26, and the forward inlet ports 53 of the motor cylinder 5. A portion of the compressed air from the forward port 241 flows through the forward guiding hole 424, the connecting slot 426, the forward semi-circular port 422, and the semi-circular slot 432 so as to assist blades 70 of the driven shaft 71 outward. In addition, when the air flows from the regulating hole 813, a front surface 814 of the regulating hole 813 can abut against the shoulder portion 2312 so as to prevent leakage.

Then, most of the compressed air introduced into the motor cylinder 5 is discharged via the outlet ports 52, the exhaust passageway 25, and the outlet passageway 221. A small portion of the air is discharged from the outlet passageway 221 via the reverse inlet ports 54, the reverse conduit 27, the reverse guiding concavity 233, the reverse semi-circular port 423 of the rear mounting plate 42, the connecting slot 427, the reverse guiding hole 425, the reverse port 242, the outlet portion 816, the discharge port 243, and the exhaust passageway 25. Accordingly, the driven shaft 71 is actuated for a reverse operation in the same manner by rotating the regulator member 81 to the reverse position.

As illustrated, the mounting housing 21 is provided directly with an eccentric cylinder chamber therein, and the front and rear bearing assemblies 6,4 are engaged in the mounting housing 21, thereby resulting in a reduction in the size of the tool. The front casing 3 is connected to the mounting housing 21 in such a manner that the rear end 32 is sleeved threadedly on the coupling end 211, thereby resulting in convenience during assembly and disassembly. In addition, the front and rear bearing assemblies 6,4 and the motor cylinder 5 are convenient to be replaced upon wearing.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A pneumatically driven power tool comprising:

a handle having upper and lower ends opposite to each other in a longitudinal direction, and defining air inlet and outlet passageways respectively extending in said longitudinal direction, said air inlet passageway being adapted to be connected to a source of compressed air;

a mounting housing disposed on said upper end, and elongated in a first transverse direction relative to said longitudinal direction, said mounting housing having a rear end portion disposed to extend in a second direction transverse to said first transverse direction, and with a first periphery, and a circumferential portion defining an axis parallel to said first transverse direction, and integrally formed with, and extending from said first periphery in said first transverse direction to form an annular coupling end opposite to said rear end portion in said first transverse direction, said circumferential portion having an outer circumferential wall fixedly secured to said upper end, and an inner circumferential wall opposite to said outer circumferential wall in a direction radial to said axis, said inner circumferential wall including:

a rear annular wall segment of a first dimension disposed around said axis and adjacent to, and forming with said rear end portion a rear abutment wall which is normal to said axis;

a rear cylindrical wall segment extending from said rear annular wall segment forwardly and in said first transverse direction, and of a second dimension larger than said first dimension so as to form a rear annular shoulder portion between said rear cylindrical Wall segment and said rear annular wall segment and normal to said axis;

an intermediate cylindrical wall segment extending from said rear cylindrical wall segment in said first transverse direction and towards said annular coupling end, and of said second dimension;

a first front cylindrical wall segment extending from said intermediate cylindrical wall segment in said first transverse direction and towards said annular coupling end, and of a third dimension larger than said second dimension so as to form a front annular shoulder portion between said first front cylindrical wall segment and said intermediate cylindrical wall segment and normal to said axis; and a second front cylindrical wall segment extending from said first front cylindrical wall segment in said first transverse direction and towards said annular coupling end, and of said third dimension;

a rear bearing member disposed to be insertable along said axis into said rear annular wall segment to abut against said rear abutment wall, and having a rear cylindrical bearing surface surrounding said axis;

a rear mounting plate disposed to be insertable along said axis into said rear cylindrical wall segment, and including a first major wall which is disposed to abut against said rear annular shoulder portion and which has a through hole aligned with said rear cylindrical bearing surface, and a first circular circumferential wall formed at a second periphery of said major wall and of a dimension to mate with said rear cylindrical wall segment;

a motor cylinder disposed to be insertable along said axis into said intermediate cylindrical wall segment, and including a rearward wall disposed to be normal to said axis so as to be brought to abut against said first major wall, a forward wall opposed to said rearward wall in said first transverse direction, and a middle circular circumferential wall interposed therebetween and of such a dimension so as to mate with said intermediate cylindrical wall segment;

a driven shaft disposed in and rotatable relative to said motor cylinder, and having a rear portion extending rearward and outwardly of said motor cylinder so as to be journalled on said rear cylindrical bearing surface, a front portion extending forward and outwardly of said motor cylinder, and a drive output end extending forward from said front portion;

a front mounting plate disposed to be insertable along said axis into said first front cylindrical wall segment, and including a second major wall which is disposed to abut against said front annular shoulder portion and which has a through hole for passage of said front portion of said driven shaft, and a second circular circumferential wall formed at a third periphery of said second major wall and of a dimension to mate with said first front cylindrical wall;

a front bearing member disposed to be insertable along said axis into said second front cylindrical wall segment, and including a rearward abutment wall disposed to abut against said front mounting plate in said first transverse direction, and a forward abutment wall opposite to said rearward abutment wall in said first transverse direction, said rearward abutment wall defining therein a front cylindrical bearing surface which surrounds said axis to journal said front portion of said driven shaft thereon, and which extends to communicate with said forward abutment wall so as to permit said drive output end to protrude forward and outwardly thereof; and an annular retaining member having an annular engaging portion disposed to be brought into engagement with said annular coupling end along said axis, and an annular retaining portion disposed to be such that when said annular retaining member is brought into engagement with said annular coupling end, said annular retaining portion will abut against said forward abutment wall of said front bearing member so as to clamp said front bearing member in cooperation with said second major wall of said front mounting plate, wherein said motor cylinder further has inlet and outlet ports respectively disposed therein and in fluid communication with said inlet and outlet passageways respectively such that the compressed air introduced from said inlet passageway into said inlet ports will drive said driven shaft, and will then be discharged from said outlet port via said outlet passageway.

2.The pneumatic driven power tool as claimed in claim 1, wherein said outer circumferential wall has front and rear inserting bores formed therein and extending radially and inwardly to communicate with said inner circumferential wall respectively at said first front cylindrical wall segment and said rear cylindrical wall segment;

said first and second circular circumferential walls respectively having first and second notches that extend inwardly and radially, and first and second lockpins disposed to be insertable into said front and rear inserting bores to engage said first and second notches respectively so as to restrain rotations of said front and rear mounting plates about said axis respectively.

3. The pneumatic driven power tool as claimed in claim 2, wherein said inlet ports include forward and reverse inlet ports, said pneumatically driven power tool further comprising a bypass power regulator disposed in said mounting housing between said motor cylinder and said air inlet passageway so as to divert and regulate amount of the compressed air introduced from said inlet passageway through said forward inlet ports or said reverse inlet ports.

4. The pneumatic driven power tool as claimed in claim 3, wherein said mounting housing further includes a back annular wall extending rearward from said rear end portion in said first transverse direction adjacent to said upper end, and confining a receiving chamber therein which is communicated with said upper end;

said rear abutment wall having a forward port and a reverse port passing therethrough in said first transverse direction and respectively communicated with said forward inlet ports and said reverse inlet ports;

said bypass power regulator having a regulating member which is rotatably received in said receiving chamber and which has a regulating hole and an inlet portion that intercommunicates said air inlet passageway and said regulating hole, and a knob disposed to rotate said regulating member between a forward position where said regulating hole is registered with said forward port, and a reverse position where said regulating hole is registered with said reverse port.

5.The pneumatically driven power tool as claimed in claim 4, further comprising a valve member disposed in said inlet passageway and operable to admit the compressed air to flow into said inlet portion of said bypass power regulator.

* * * * *